United States Patent [19]

Tyson

[11] Patent Number: 5,074,491

[45] Date of Patent: Dec. 24, 1991

[54] METHOD FOR CORRECTING MISALIGNMENT BETWEEN MULTIPLE MISSILE TRACK LINKS

[75] Inventor: John A. Tyson, Lawndale, Calif.

[73] Assignee: Hughes Aircraft Company, Los Angeles, Calif.

[21] Appl. No.: 566,923

[22] Filed: Aug. 14, 1990

[51] Int. Cl.[5] ..... F41G 7/32; F42B 15/04

[52] U.S. Cl. ..... 244/3.11; 244/3.12; 244/3.16

[58] Field of Search ..... 244/3.11, 3.12, 3.14, 244/3.13, 3.15, 3.16, 3.17, 3.19

[56] References Cited

U.S. PATENT DOCUMENTS

| | | | |
|---|---|---|---|
| H.400 | 1/1988 | Hammon et al. | 244/3.11 |
| 3,567,163 | 3/1971 | Kepp et al. | 244/3.14 |
| 3,807,658 | 4/1974 | Miller, Jr. et al. | 244/3.13 |
| 4,136,343 | 1/1979 | Heffner et al. | 244/3.19 X |
| 4,174,818 | 11/1979 | Glenn | 244/3.13 |
| 4,179,085 | 12/1979 | Miller, Jr. | 244/3.11 |
| 4,183,482 | 1/1980 | Jozwiak | 244/3.16 |
| 4,274,609 | 6/1981 | Ferrier et al. | 244/3.14 |
| 4,378,918 | 4/1983 | Miller, Jr. et al. | 244/3.11 |
| 4,406,429 | 9/1983 | Allen | 244/3.11 |
| 4,566,656 | 1/1986 | Maudal et al. | 244/3.11 |
| 4,611,771 | 9/1986 | Gibbons et al. | 244/3.12 |
| 4,699,332 | 10/1987 | Bigot et al. | 244/3.11 |
| 4,705,237 | 11/1987 | Goldfeld et al. | 244/3.12 |
| 4,721,270 | 1/1988 | Salkeld | 244/3.11 |
| 4,732,349 | 3/1988 | Maurer | 244/3.13 |
| 4,750,688 | 6/1988 | Davies | 244/3.11 |
| 4,967,979 | 11/1990 | Balstad | 244/3.11 |

*Primary Examiner*—John B. Sotomayor
*Attorney, Agent, or Firm*—William J. Streeter; Georgann S. Grunebach; W. K. Denson-Low

[57] ABSTRACT

A method for measuring boresight and parallax misalignment between multiple missile track links and for compensating guidance of a missile to a selected target. The method is applicable to any missile tracking system employing multiple track links. A missile is projected toward a target along a line of sight and tracked by multiple tracking sensors. Instantaneous output signals of any two tracking sensors are compared to determine instantaneous errors in boresight, parallax, or random errors. The error information is used to compute boresight and parallax correction terms. The correction terms are fed into conventional missile guidance algorithms to correct errors between the tracking sensor's line of sight and an operator's line of sight. Misalignment is measured during missile flight and the missile is used as a reference source in measuring the misalignments. The method is useful in tracking systems mounted on moving vehicles where accurate alignment of track links is difficult. The invention is also be useful in automatically preventing missile misses due to accidental misalignments in systems where the operator has manual control of the misalignment.

8 Claims, 2 Drawing Sheets

METHOD FOR CORRECTING MISALIGNMENT BETWEEN MULTIPLE MISSILE TRACK LINKS

BACKGROUND

The present invention relates generally to missile guidance systems, and more particularly, to a method for measuring boresight and parallax errors between multiple missile track links, and for compensating missile guidance commands for these errors.

Missile guidance may involve multiple lines of sight. In conventional guidance systems, such as tube-launched, optically-tracked, wire-guided (TOW) guidance systems, an operator typically has a choice of two sighting systems to track a target. A missile is simultaneously tracked by two tracking subsystems, co-located with a telescope used by the operator. When tracking the target, the most effective sighting system to use under a given set of battlefield conditions is selected by the operator. For existing TOW guidance systems employing dual track capability, the operator has a choice of a "day" sight or a "night" sight. The day sight operates in the visible spectral region, either a direct view optical system or television system. The night sight operates in the far infrared spectral region. The line of sight is defined by a tracking reticle in a display viewed by the operator, in both sighting systems. The operator tracks the target by positioning the tracking reticle on the target.

The missile is tracked by two or more tracking sensors in existing TOW systems. A first tracking sensor operates in the near infrared spectral region. A second tracking sensor operates in the far infrared spectral region. Each sensor tracks the missile to the extent that it is capable in a particular environment. The sensors produce error signals proportional to the angular deviation of the missile from the line of sight. Logic in the guidance system determines which tracking sensor's output signals to use in guiding the missile based on the relative quality of data from each sensor.

Boresight errors between these lines of sight are a major factor in accuracy when guiding the missile to the target, particularly at long range. Parallax between the lines of sight can also affect accuracy. Present alignment concepts control the boresight errors by a combination of manufacturing tolerances, factory alignments, alignments by field service personnel, and operator adjustments to control the overall track link alignments. The final alignments are highly dependent on the accuracy with which various individuals make these alignments, and are susceptible to accidental misalignment.

A major limitation of present concepts is the final alignment between the operator's various tracking sensors. This is typically a field operation using a target of opportunity. The operator switches back and forth between tracking sensors and manually adjusts knobs until the target's position coincides in the fields of view of the tracking sensors. This manual operation provides an additional error source and introduces the real possibility of the operator's accidental introduction of large errors into the track loop. The usual assumption in system performance analysis is that this additional error source is comparable in magnitude to other error sources.

The effectiveness of the system ultimately depends on how well the tracking sensor used to guide the missile is aligned to the reticle of the sight that the operator uses to track the target. The alignment of the near infrared sensor to the day sight has been tightly controlled by a combination of manufacturing tolerances, and factory and field alignments, both manual and automatic. There is similar control of the alignment of the far infrared sensor to the night sight. These tolerances and alignments are sufficient to control overall alignment when the operator uses the day sight and guidance is developed from the near infrared tracker or when the operator uses the night sight and the far infrared is used for missile guidance.

When there is a cross-tracking situation, the alignment between the day and night sight becomes an error source. Cross-tracking occurs when the operator uses the day sight and guidance developed from far infrared data, or uses the night sight with guidance developed from near infrared data. This alignment is a manual adjustment that the operator can make at any time at his discretion. In performance analysis, assumptions are made as to the accuracy of this alignment. There is no guarantee that the operator will have made the alignment accurately. There exists a real possibility that the sights will be accidentally misaligned by large amounts. Accordingly, there exists a need for reducing boresight and parallax errors and improving system alignments.

It is an objective of the present invention to provide an improved method of measuring misalignment between multiple missile track links, and compensating guidance of a missile to a selected target. Another objective of the invention is the reduction of boresight errors when guiding the missile toward the target. A further objective of the present invention is the compensation for parallax errors in the tracking system. A still further objective of the present invention is to compensate for errors introduced manually into the tracking system.

SUMMARY OF THE INVENTION

In accordance with these objectives and the principles of the present invention, there is provided a method that measures boresight and parallax misalignments between multiple missile track links, and compensates the missile guidance to its target. The invention is applicable to any missile tracking system having multiple track links.

A missile is projected toward a target along a line of sight, and is tracked by multiple tracking sensors. Instantaneous output signals from the tracking sensors are compared to determine instantaneous errors in boresight, parallax, or random errors. The error data is used to compute boresight and parallax correction terms. The correction terms are fed into a computer as inputs to a missile guidance algorithm to compensate for misalignment errors between the multiple missile tracking links.

The invention is particularly useful in tracking systems mounted on moving platforms where accurate alignment of the track links is difficult. Various airborne TOW systems fall in this category. The invention is also useful in preventing missile misses due to accidental misalignment when the operator has manual control of the misalignment. Existing TOW systems with dual mode capability are in this category.

The present invention supplements manual control by the operator. This alleviates limitations in manual final alignment of the various sensors. The invention automatically measures the error between missile track links during each missile firing and compensates the missile guidance commands for the measured errors. The invention compensates for parallax between the missile track links. This removes parallax as a factor in guidance accuracy. The boresight correction procedure provides a final alignment check as the missile flies downrange and corrects for errors as needed.

BRIEF DESCRIPTION OF THE DRAWINGS

The various features and advantages of the present invention may be more readily understood with reference to the following detailed description taken in conjunction with the accompanying drawing, wherein like reference numerals designate like structural elements, and in which.

DETAILED DESCRIPTION

By way of introduction, the method of the present invention is applicable to any system having multiple track links. The method described herein is for a dual-mode missile tracker tracking a TOW2 missile, for example. In a TOW2 system, an operator has a choice of two sights for target tracking. The missile has two tracking beacons at the rear thereof that emit radiation. The operator's display has two tracking reticles aligned with two tracking sensors that track the emitted radiation from the beacons. TOW guidance systems are essentially "command to line of sight". Prior to and during missile guidance the operator tracks a target with a sight of his choice establishing a line of sight to the target. As a missile flies toward the target its deviation from the line of sight is measured by one or more missile trackers. The measured deviation is processed to generate missile commands to guide the missile back to the line of sight.

The operator typically has a choice of two or more sighting systems with which to track the target and selects the most effective one to use under a given set of battlefield conditions. For existing TOW systems employing dual track capability the operator may choose either a "day" or "night" sight. The day sight operates in a visible spectral region, either a direct view optical system or television system. The night sight operates in a far infrared spectral region. In each sighting system the line of sight is defined by a tracking reticle in a display used by the operator. The operator tracks the target by positioning the tracking reticle on the target.

The missile is typically tracked by two or more tracking sensors in existing TOW systems. The sensors usually comprise a sensor operating in the near infrared spectral region and a sensor operating in the far infrared spectral region. Each sensor tracks the missile to the extent that it is capable in a particular battlefield environment. The sensors produce error signals proportional to the angular deviation of the missile from the line of sight. Logic in the guidance system determines which sensor's output to use in guiding the missile based on the relative quality of data from each sensor.

Figure 1:
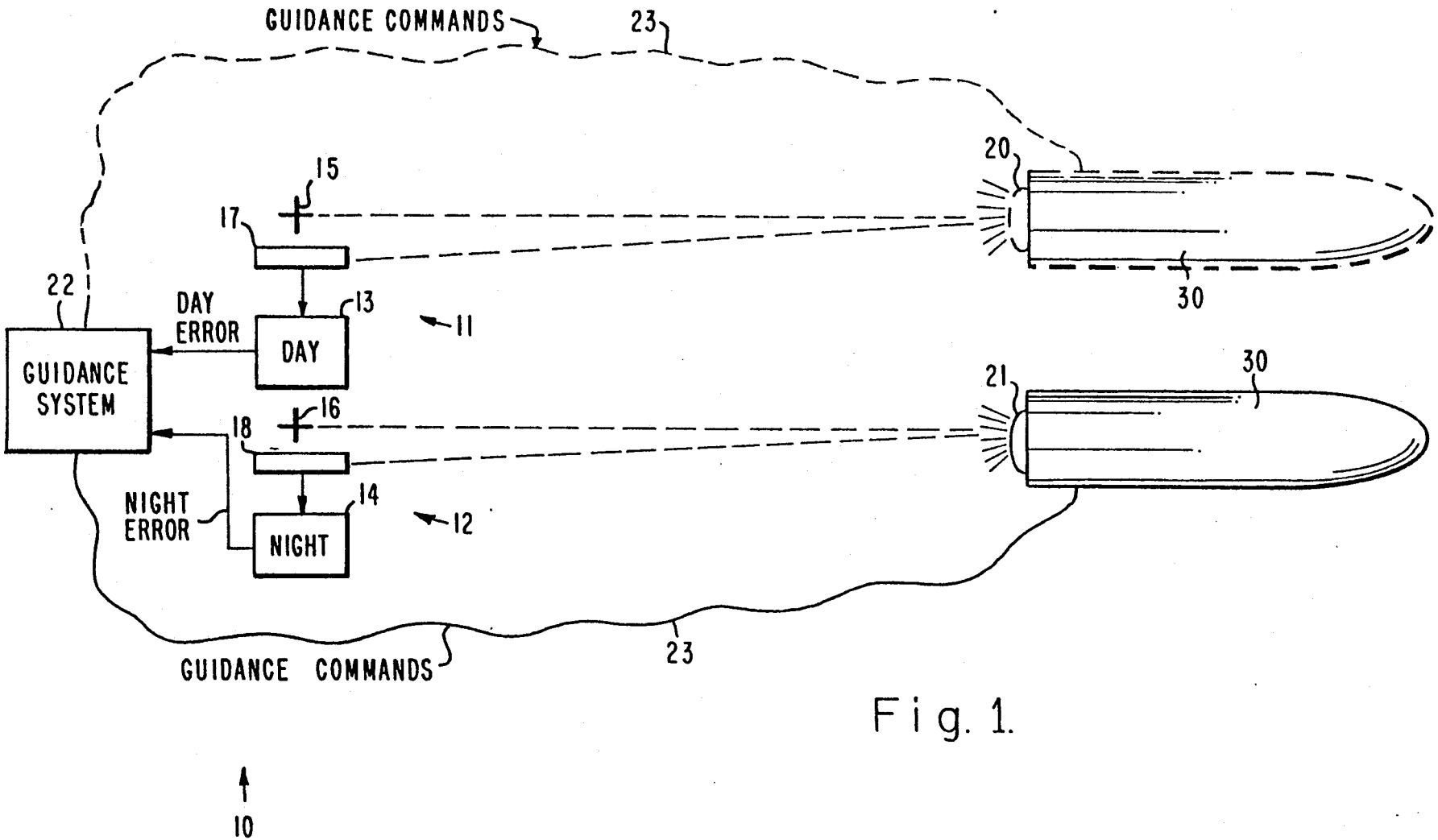
FIG. 1 is an illustration of a missile guidance system incorporating the principles of the present invention.
Figure 2:
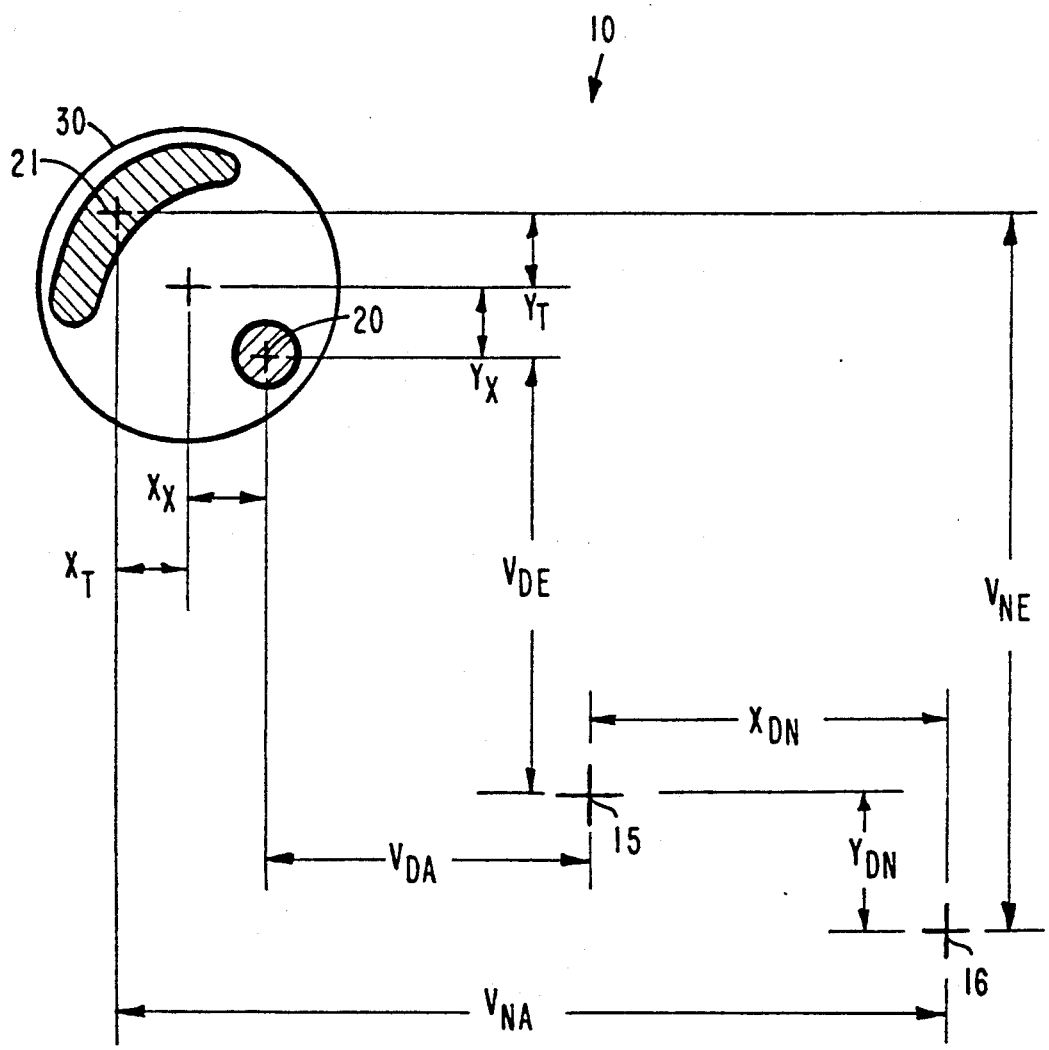
FIG. 2 is a schematic drawing showing missile tracking geometry that is useful in explaining the method of correcting boresight alignment in accordance with the principles of the present invention.

Referring now to the drawings, FIG. 1 is an illustration of a missile guidance and tracking system 10, such as a TOW2 tracking system, for example, while FIG. 2 shows the tracking geometry for a missile 30. Although the missile 30 is shown as two phyusical objects in FIG. 1, it is to be understood that there is only one physical object, and the two tracking links 11, 12, when aligned, are substantially coincident and focus on the rear of the missile 30 as shown in FIG. 2. The system 10 includes two tracking links 11, 12 which comprise a day sight 13 and a night sight 14, each sight having a respective sighting reticle 15, 16. Each sight 13, 14 has its own beacon tracking sensor 17, 18, respectively, each of which are accurately aligned with the respective reticles 15, 16 and adapted to track respective day and night beacons 20, 21. Each beacon tracking sensor 17, 18 is adapted to output tracking error signals to its respective sight 13, 14 and these error signals are coupled to a guidance computer 22 that provides guidance signals along a wire 23 to the missile 30.

A schematic representation of a TOW2 missile 30 is shown in FIG. 2. The day beacon 20 is disposed in a lower right quadrant of the missile 30. The day beacon 20 may be a xenon beacon 20, for example, and serves as the primary tracking source for a near infrared tracking sensor 17 comprising the day beacon sensor 17. The night beacon 21, which may be a thermal beacon 21, is disposed in an upper left quadrant of the missile 30 and serves as the primary tracking source for a far infrared tracking sensor 18 comprising the night beacon sensor 18.

The near infrared tracking sensor 17 has primary output signals $V_{DE}$ and $V_{DA}$ representing angular displacements in elevation and azimuth, respectively, of the xenon beacon 18 with respect to the near infrared tracking sensor 17 line of sight. A similar pair of outputs $V_{NA}$ and $V_{NE}$ are generated by the far infrared tracking sensor 18. Units for the output signals are assumed to be in milliradians. Standard polarities for TOW2 systems 10 of positive signal for target source below and to the right of the sensor lines of sight are used. Significant parallax sources $X_T$, $X_X$, $X_{DN}$, $Y_T$, $Y_X$, $Y_{DN}$ in the TOW2 system 10 are shown.

In missile flight, the missile 30 is conventionally tracked by a missile guidance system 10 having multiple tracking sensors 17, 18. There are time periods when the tracking sensors 17, 18 are known to be tracking the missile 30 accurately. In a TOW2 guidance system 10, this is the period between flight motor burnout and a time at which one of the tracking links 11, 12 is degraded by environmental factors or countermeasures. During this period, the instantaneous output signals of the tracking sensors 17, 18 are compared. The instantaneous error between the two tracking links 11, 12 falls into three general categories: constant angular errors or boresight errors, errors due to parallax between the tracker lines of sight and tracked sources on the missile 30 which varies systematically with the missile to sensor range, and random errors, which vary from sample to sample.

For a given missile 30 and set of tracking sensors 17, 18, the parallax errors are accurately known. The instantaneous tracking sensor output signals can be compensated for these, assuming a nominal missile range to time profile or measured missile range data if available. The random sample-to-sample errors can then be removed using an averaging technique. A typical averaging algorithm has the form:

$$Bab_{i+1}=\{1-A(t)^*Qa_i^*Qb_i\}Bab_i+A(t)^*Qai^*Qbi(Ea_i-Eb_i).$$

In this equation, $Bab_i$ and $Bab_{i+1}$ are successive iterations of the boresight correction between sensors "a" and "b", A(t) is a predetermined weighting factor which may vary with time from missile launch, Qa is a quality weighting factor for sensor "a", Qb is a quality weighting factor for sensor "b", Ea is the parallax corrected output of sensor "a" and Eb is the parallax corrected output of sensor "b".

In this algorithm, the quality factors Qa and Qb vary between 0 and 1 depending on the assessment of the current quality of the output signals from a particular tracking sensor 17, 18. A higher quality factor is desirable. Values of "1" for both tracking sensors 17, 18 allows for maximum use of the current outputs in the boresight correction term, and a value of "0" for tracking sensor 17, 18 prevents use of the current information in the calculations. This freezes the value of Bab at the previously computed value. The value of A(t) similarly falls between 0 and 1, and controls the relative influence of new instantaneous measurements to the previous values in computing Bab. The boresight correction term computed in this manner can then be applied to the missile guidance algorithms to correct errors between the operator's and missile tracking sensor's lines of sight.

Once the boresight correction term(s) are known, these and parallax correction terms are applied to the tracking sensor's outputs to correct the outputs to the operator's selected line of sight. These corrected signals, when input to the missile guidance algorithms, ensure that the missile is properly guided along the operator's line of sight.

The effectiveness of the system 10 ultimately depends on how well the sensor used to guide the missile is aligned to the reticle of the sight that the operator uses to track the target. Historically, the alignment of the near infrared sensor 17 to the day sight 13 has been tightly controlled by a combination of manufacturing tolerances and factory alignments, and field alignments, both manual and automatic, where necessary. There is a similar control of the alignment of the far infrared sensor 18 to the night sight 14. These tolerances and alignments are sufficient to control overall alignment when the operator is using the day sight 13 and guidance is developed from the near infrared tracker 18, or when the operator is using the night sight 14 and the far infrared sensor 18 is used for missile guidance.

When there is a "cross-tracking" situation, in that the operator (1) uses the day sight 11 and guidance developed from far infrared data or (2) uses the night sight 12 with guidance developed from near infrared data, the alignment between the day and night sight 11, 12 becomes an error source. This alignment is a manual adjustment that the operator can make at any time at his discretion. In analyzing performance, assumptions are made as to the accuracy with which this alignment has been made. However, there is no guarantee that the operator will have made the alignment to this accuracy, and there exists a real possibility that the two sights will be accidentally misaligned by large amounts. It is this error that the present invention corrects.

Thus there has been described a new and improved method for measuring boresight and parallax misalignments between multiple missile track links, and for compensation of these misalignments when guiding a missile to a selected target. The method of the invention supplements manual alignment procedures. The invention automatically measures the error between missile track links during each missile firing and compensates the missile guidance commands for the measured errors. The invention removes parallax as a factor in guidance accuracy.

It is to be understood that the above-described embodiment is merely illustrative of some of the many specific embodiments which represent applications of the principles of the present invention. Clearly, numerous and other arrangements can be readily devised by those skilled in the art without departing from the scope of the invention.

What is claimed is:

1. In a missile guidance system in which the missile has a plurality of tracking beacons at the rear thereof, and in which a plurality of beacon sensors are provided to form multiple target links, a method of compensating for misalignments between the multiple target tracking links in the missile guidance system, said method comprising the steps of:

projecting a missile toward a target;

tracking the target using a plurality of target tracking links;

measuring the line of sight error between the plurality of target tracking links;

computing an error correction term from the measured line of sight error;

applying the error correction term to the missile to compensate missile guidance commands for the error between the lines of sight of the multiple target tracking links.

2. In a guidance system for a missile having two tracking beacons at the rear thereof, a method of compensating for misalignments between two missile tracking links having two separate lines of sight, said method comprising the steps of:

projecting the missile toward a target;

optically tracking the target;

automatically measuring the boresight error between the two tracking links to obtain a correction term defining the error between the two lines of sight; and compensating the missile guidance commands using the error correction term to correct for the measured error between the two lines of sight.

3. A method of accurately guiding a missile having a plurality of beacons and employing a missile guidance system incorporating a plurality of missile tracking links having misalignment therebetween, said method comprising the steps of:

projecting a missile toward a target;

tracking the target along a line of sight of a selected missile tracking link;

tracking the missile with the plurality of tracking links, the tracking links adapted to provide error output signals indicative of the missile guidance commands proportional to the angular deviation of the missile from the lines of sight of the missile tracking links;

automatically measuring the error between the missile tracking links by comparing the instantaneous guidance commands provided thereby and by using the missile as a reference standard;

computing error correction signals for each tracking link using the measured error; and applying the error correction signals to the missile guidance system to correct for errors between the tracking links line of sight.

4. In a missile guidance system having a missile, multiple missile tracking sensors, multiple target tracking links each comprising a target tracking reticle and a tracking beacon, and wherein the missile guidance system is adapted to guide the missile toward a target, an improved method of reducing cross-tracking and parallax errors in the guidance system comprising the steps of:

projecting the missile toward the target along a line of sight of a selected one of the multiple target tracking links;

tracking the target with the tracking reticle corresponding to the selected tracking link;

generating instantaneous error output signals from each of the multiple target tracking links that are indicative of the error between the missile position and the lines of sight of the multiple target tracking links;

comparing the instantaneous error output signals of any two of the multiple target tracking links to generate instantaneous misalignment error signals;

computing missile guidance error correction terms using the instantaneous misalignment error signals; and applying the missile guidance error correction terms to the missile guidance system to correct misalignment errors between the lines of sight of the multiple target tracking links.

5. In a missile guidance system comprising a missile, multiple missile tracking sensors, multiple target tracking links each having a tracking reticle that is optically aligned with a respective one of the missile tracking links, and an operator, and wherein each target tracking link is adapted to simultaneously provide a desired line of sight to a target, and wherein the operator selects one of the target tracking links to track the target and selects one of the missile tracking sensors to provide missile guidance control signals to the missile, an improved method of measuring and reducing boresight and parallax errors caused by cross-track misalignment, said method comprising the steps of:

projecting the missile toward the target along a line of sight of a selected one of the missile tracking links;

tracking the target with the tracking reticle corresponding to the selected tracking link; tracking the target with a selected tracking link and tracking reticle controlled by the operator;

generating instantaneous error output signals from each of the target tracking links, and wherein the instantaneous error output signals are indicative of the error between the missile position and the lines of sight of the multiple target tracking links;

comparing the instantaneous error output signals of any two missile tracking links to generate instantaneous misalignment error signals;

computing missile guidance error correction terms from the instantaneous error signals; and applying the missile guidance error correction terms to the guidance system to correct misalignment errors between the lines of sight of the target tracking links.

6. In a missile guidance system comprising a missile, multiple missile tracking sensors, multiple target tracking links each having a target tracking beacon that is optically aligned with a missile tracking reticle of a respective one of the missile tracking links, and an operator, and wherein each target tracking sensor is adapted to provide output signals indicative of a desired line of sight to a target while the missile is in flight, and wherein the operator selects one of the target tracking sensors to track the target and selects one of the missile tracking links to provide guidance control signals to the missile, a method of correcting for cross-tracking errors encountered in tracking the missile toward the target, said method comprising the steps of:

tracking the target;

projecting the missile toward the target along the desired line of sight;

tracking the target with a selected target tracking link and guiding the missile in response to signals provided by a selected missile tracking link, each respective missile tracking link adapted to track a specific beacon on the missile and provide error output signals indicative of the angular error between the tracking links' line of sight to the beacon and the desired line of sight to the target;

computing error correction signals in response to the error output signals; and applying the error correction signals to the missile guidance system to correct missile guidance command signals applied to the missile to correct line of sight pointing errors between the selected tracking sensor's line of sight and the desired line of sight.

7. In a missile guidance system comprising a missile having multiple beacons, multiple target tracking links each having a sighting reticle that is optically aligned with a beacon sensor responsive to one of the multiple beacons, and an operator, and wherein each target tracking link is adapted to provide a line of sight to the target while the missile is in flight, and wherein the guidance system is adapted to measure deviation of the missile from the lines of sight by tracking the beacons and generating missile guidance commands proportional to the angular deviation of the missile from the lines of sight, and wherein the guidance system is adapted to select between the outputs of the beacon sensors based on the relative quality of the data from each sensor, and wherein the operator selects one of the sighting reticles to track the target while the guidance system automatically selects one of the multiple tracking links based on signal quality, a method of compensating for misalignments between the multiple target tracking links comprising the steps of:

optically tracking the target with a selected sighting reticle;

projecting the missile toward the target along a desired line of sight;

automatically measuring the error between the multiple target tracking links by comparing the instantaneous outputs of the beacon sensors;

computing an error correction term comprising the error between the lines of sight of the multiple target tracking links;

applying the error correction term to the missile guidance command signals to compensate the missile guidance commands for the measured error between the lines of sight of the multiple target tracking links.

8. A method of compensating for misalignments between two missile tracking links in a guidance system for a missile having a xenon beacon and a thermal beacon, the system including a first tracking link having a first sighting reticle and a xenon beacon sensor, the system including a second tracking link having a second sighting reticle and a thermal beacon sensor, the first and second reticles defining first and second lines of sight respectively, and wherein the guidance system is adapted to measure deviation of the missile from the respective lines of sight by tracking the beacons and generating missile guidance commands proportional to the angular deviation of the missile from the lines of sight, and wherein the guidance system is adapted to automatically select between the output of the xenon beacon sensor and the thermal beacon sensor based on the relative quality of the data provided by each sensor, wherein the improvement comprises the steps of:

optically tracking the target with a selected sighting reticle;

projecting the missile toward the target along a desired line of sight;

automatically measuring the error between the first and second tracking links by comparing the instantaneous output of the xenon beacon sensor with the instantaneous output of the thermal beacon sensor to obtain a correction term for the error between the first and second lines of sight; and compensating the missile guidance commands for the measured error between the first and second lines of sight.

* * * * *